US005704003A

United States Patent [19]

Kleijn et al.

[11] Patent Number: 5,704,003

[45] Date of Patent: Dec. 30, 1997

[54] RCELP CODER

[75] Inventors: Willem Bastiaan Kleijn, Basking Ridge; Dror Nahumi, Ocean, both of N.J.

[73] Assignee: Lucent Technologies Inc., Murray Hill, N.J.

[21] Appl. No.: 530,040

[22] Filed: Sep. 19, 1995

[51] Int. Cl.[6] ..... G10L 5/00

[52] U.S. Cl. ..... 395/2.29; 395/2.25

[58] Field of Search ..... 395/2.25–2.29

[56] References Cited

U.S. PATENT DOCUMENTS

| | | | |
|---|---|---|---|
| 3,624,302 | 11/1971 | Atal | 179/1 SA |
| 4,701,954 | 10/1987 | Atal | 381/49 |
| 5,339,384 | 8/1994 | Chen | 395/2.2 |

OTHER PUBLICATIONS

Ser. No. 07/990309 now pending Kleijn filed Dec. 14, 1992.
Ser. No. 08/234504 now pending Kleijn filed Apr. 28, 1994.
Kleijn et al., "A 5.85 kb/s CELP Algorithm for Cellular Applications," IEEE ICASSP–93, vol. 2, pp. 596–599, Apr. 1993.

*Primary Examiner*—Allen R. MacDonald
*Assistant Examiner*—Robert C. Mattson
*Attorney, Agent, or Firm*—Steven R. Bartholomew

[57] ABSTRACT

An improved method of speech coding for use in conjunction with speech coding methods wherein speech is digitized into a plurality of temporally defined frames, each frame including a plurality of sub-frames, and the digitized speech is partitioned into periodic components and a residual signal. For each of a plurality of sub-frames of the residual signal, the improved method of speech coding selects and applies a time shift T to the sub-frame by applying a matching criterion to (a) the current sub-frame of the residual signal, and (b) a sample-to-sample (subframe-to-subframe) pitch delay determined by applying linear interpolation to known pitch delays occurring at or near frame-to-frame boundaries of previous frames.

The matching criterion is applied by minimizing $\epsilon$, where:

$$\epsilon = \sum_n (r(n-T) - r(n-D(n)))^2.$$

(r(n–T)) is the residual signal of the current frame shifted by time T, r(n–D(n)) is the delayed residual signal from a previously-occurring frame, n is a positive integer, r is the instantaneous amplitude of the residual signal, and D(n) is the sample-to-sample pitch delay determined by applying linear interpolation to known pitch delay values occurring at or near frame-to-frame boundaries.

5 Claims, 2 Drawing Sheets

RCELP CODER

BACKGROUND OF THE INVENTION

1. Field of the Invention

The invention relates generally to speech coding, and more specifically to coders using relaxation code-excited linear predictive techniques.

2. Background

The frequency components of speech, termed periodicity, vary as a function of time, and also as a function of frequency. Periodicity, an important speech attribute, is a form of speech signal redundancy which can be advantageously exploited in speech coding. Oftentimes, the frequency components of speech remain substantially similar for a given time period, which offers the potential of reducing the number of bits required to represent a speech waveform. To provide high-quality reconstructed speech, the degree of periodicity present in the original speech sample must be accurately matched in the reconstructed speech. Ideally, this accurate matching should not be vulnerable to communications channel degradations which are typically present in the operating environment of a speech coder, and frequently result in the loss of one or more bits of the coded speech signal.

One existing speech coding technique is code-excited linear-predictive (CELP) coding. CELP coding increases the efficiency of speech processing techniques by representing a speech signal in the form of a plurality of speech parameters. For example, one or more speech parameters may be utilized to represent the periodicity of the speech signal. The use of speech parameters is advantageous in that the bandwidth occupied by the CELP-coded signal is substantially less than the bandwidth occupied by the original speech signal.

The CELP coding technique partitions speech parameters into a sequence of time frame intervals, wherein each frame has a duration in the range of 5 to 20 milliseconds. Each frame may be partitioned into a plurality of sub-frames, wherein each sub-frame is assigned to a given speech parameter or to a given set of speech parameters. Each of these frames includes a pitch delay parameter that specifies the change in pitch value from a predefined reference point in a given frame to a predefined point in the immediately preceding frame. The speech parameters are applied to a synthesis linear predictive filter which reconstructs a replica of the original speech signal. Systems illustrative of linear predictive filters are disclosed in U.S. Pat. No. 3,624,302 and U.S. Pat. No. 4,701,954, both of which issued to B. S. Atal, and both of which are incorporated by reference herein.

Existing code-excited linear-predictive (CELP) coders exploit periodicity through the utilization of a pitch predictor or an adaptive codebook. There are substantial similarities between these structures and, therefore, the following discussion will assume the use of an adaptive codebook. In each sub-frame, the speech parameters applied to the synthesis linear predictive filter represent the summation of an adaptive codebook entry and a fixed codebook entry. The entries in the adaptive codebook represent a set of trial estimates of speech segments derived from a plurality of previously reconstructed speech excitations. These entries each include substantially identical representations of the same signal waveform, with the exception that each such waveform representation is offset in time from all remaining waveform representations. Therefore, each entry may be expressed in the form of a temporal delay relative to the current sub-frame, and, hence, each entry may be referred to as an adaptive codebook delay.

Existing analysis-by-synthesis techniques are used to select an appropriate adaptive codebook delay for each sub-frame. The adaptive codebook delay selected for transmission, (i.e., for sending to the linear predictive filter) is the adaptive codebook delay that minimizes the differences between the reconstructed speech signal and the original speech signal. Typically, the adaptive codebook delay is close to the actual pitch period (predominant frequency component) of the speech signal. A predictive residual excitation signal is utilized to represent the difference between the original speech signal used to generate a given frame and the reconstructed speech signal produced in response to the speech parameters stored in that frame.

Good reconstructed speech quality is obtained if the transmitted adaptive codebook delay is selected in a range from about 2 to 20 ms. However, the resolution of the reconstructed speech decreases as the adaptive codebook delay increases. In general, the pitch period (predominant frequency component) of the speech varies continuously (smoothly) as a function of time. Thus, good performance can be obtained if the range of acceptable adaptive codebook delays is constrained to be near a pitch period estimate, determined only once per frame. The constraint on the range of acceptable adaptive codebook delays results in smaller adaptive codebooks and, thus, a lower bit rate and a reduced computational complexity. This approach is used, for example, in the proposed ITU 8 kb/s standard.

Further improvement of the coding efficiency of the adaptive codebook is possible through the application of generalized analysis by synthesis techniques in the context of relaxation code-excited linear predictive (RCELP) coding. For example, the concept of an adaptive codebook delay trajectory may be advantageously employed. This adaptive codebook delay trajectory is set to equal a pitch-period trajectory (i.e., change in the predominant frequency component of speech) that is obtained by linear interpolation of a plurality of pitch period estimates. The residual signal defined above is distorted in the time domain (i.e., time-warped) by selectively time-advancing or time-delaying some portions of the residual signal relative to other portions, and the mathematical function that is used to time-warp the residual signal is based upon the aforementioned adaptive codebook delay trajectory, which is mathematically represented as a piecewise-linear function. Typically, the portions of the signal that are selectively delayed include pulses and the portions of the signal that are not delayed do not include pulses. Thus, the adaptive codebook delay is transmitted only once per frame (≈20 ms), lowering the bit rate. This low bit rate also facilitates robustness against channel errors, to which the adaptive codebook delay is sensitive. Although existing RCELP coding techniques provide some immunity to frame erasures, what is needed is an improved RCELP coding scheme that provides enhanced robustness in environments where frame erasures may be prevalent.

In RCELP, the pitch period is estimated once per frame, linearly interpolated on a sample-by-sample basis and used as the adaptive codebook delay. The residual signal is modified by means of time warping so as to maximize the accuracy of the interpolated adaptive codebook delay over a period of time. The time warping is usually done in a discrete manner by linearly translating (i.e., time-shifting) time-shifting segments of the residual signal from the linear predictive filter in the time domain to match the adaptive codebook contribution to the coded signal that is applied to the linear predictive filter. The segment boundaries are constrained to fall in low-power segments of the residual signal. In other words, the entire segment of a signal that contains a pulse is shifted in time, and the boundaries of the segment including the pulse are selected so as not to fall on or near a pulse. The exact shift for each segment is determined by a closed-loop search procedure. The remaining operations performed by RCELP coders are substantially similar to those that are performed by conventional CELP coders, with one major difference being that, in RCELP, modified original speech (obtained from the modified linear predictive residual signal) is used, whereas, in CELP, the original speech signal is used.

At higher bit rates, the generalized-analysis-by-synthesis method is efficient only when the modified original speech is of the same quality as the original speech. Recent tests of RCELP implementations showed a degradation in the quality of the modified speech for some speech segments. This decrease in quality of the modified speech results in a degradation of the reconstructed speech, especially for medium-rate speech coders (6–8 kb/s). The foregoing description of RCELP coding is more particularly set forth in U.S. patent application Ser. Nos. 07/990,309 and 08/234,504, the disclosures of which are hereby incorporated by reference.

As stated above, in RCELP coding, the residual signal is modified by means of "time warping" so as to maximize the accuracy of the interpolated adaptive codebook delay contour. In this context, artisans frequently employ the term "time-warping" to refer to a linear translation of a portion of the residual signal along an axis that represents time. To determine the accuracy of a given interpolated adaptive codebook contour, a mathematical measurement criterion may be employed. The criterion used in existing RCELP coding is to maximize the correlation (i.e., minimize the mean-squared error) between (i) the time-shifted residual signal r(n–T), where T is the time shift, n is a positive integer, and r is the instantaneous amplitude of the residual signal; and (ii) the adaptive codebook contribution to the excitation, e(n–D(n)), wherein this mathematical expression signifies that e is a function of (n–D(n)), D(n) represents the adaptive codebook delay function, n represents a positive integer, and e represents the instantaneous amplitude of the adaptive codebook excitation. The matching procedure searches for the time shift T which minimizes the mean-squared error defined by:

$$\epsilon = \sum_n (r(n-T) - e(n-D))^2. \quad (1)$$

This criterion results in a closed-loop modification of the residual speech signal such that it is best described by the linear adaptive codebook delay contour. Since information about the time shift T is not transmitted, this time shift T must be calculated or estimated. Therefore, the maximum resolution of time shift T is limited only by the computational constraints of existing system hardware. The use of the above-cited closed-loop criterion is disadvantageous because, in speech segments where the adaptive codebook signal has a low correlation with the residual speech signal (e.g. in non-periodic speech segments), the time shift T derived from the matching criterion sometimes results in artifacts (undesired features) in the modified residual speech signal.

Existing RCELP coders are based upon the assumption that the energy concentrated around a pitch pulse is much larger than the average energy of the signal. Only pitch pulses are subjected to shifts. Recent tests showed that this assumption is not valid for some source material. Therefore, there is a need to develop a new peak-to-average ratio criterion for purposes of determining whether or not time shifting should be applied within a given sub-frame.

SUMMARY OF THE INVENTION

An improved method of speech coding for use in conjunction with speech coding methods wherein speech is digitized into a plurality of temporally defined frames, each frame including a plurality of sub-frames, each frame setting forth a pitch delay value specifying the change in pitch with reference to the immediately preceding frame, each sub-frame including a plurality of samples, and the digitized speech is partitioned into periodic components and a residual signal. For each of a plurality of sub-frames of the residual signal, the improved method of speech coding selects and applies a time shift T to the sub-frame by applying a matching criterion to (a) the current sub-frame of the residual signal, and (b) sample-to-sample pitch delay values for each of n samples in the current sub-frame, wherein these pitch delay values are determined by applying linear interpolation to known pitch delays occurring at or near frame-to-frame boundaries of previous frames. The matching criterion improves the perceived performance of the speech coding system.

The matching criterion is:

$$\epsilon = \sum_n (r(n-T) - r(n-D(n)))^2. \quad (2)$$

In the above equation, the expression (r(n–T)) represents the instantaneous amplitude of the residual signal of the current frame shifted by time T, and the expression r(n–D(n)) represents the instantaneous amplitude of the delayed residual signal from a previously-occurring frame, wherein n is a positive integer and D(n) represents sample-to-sample pitch delay values determined for each of n samples by applying linear interpolation to known pitch delay values occurring at or near frame-to-frame boundaries, wherein each sub-frame includes a plurality of samples and may be conceptualized as representing the correlation of a residual signal to the time-shifted version of that same signal.

In this manner, the pitch delay of the residual signal in the current sub-frame is modified to match the interpolated pitch delay of a residual signal obtained from preceding sub-frames in an open-loop manner. In other words, the time shift is not determined by using "feedback" obtained from the adaptive codebook excitation. Note that the prior art criterion set forth in equation (1) employs the term e(n–D(n)) to represent this adaptive codebook excitation, whereas the node criterion set forth herein does not contain a term for adaptive codebook excitation. The use of an open-loop approach eliminates the dependence of the time shift on the correlation between sample-to-sample pitch delay and the residual signal. This criterion compensates for temporal misalignments between the adaptive codebook excitation e(n–D(n)) and the residual signal r(n).

A further embodiment sets forth improved time shifting constraints to remove additional artifacts (undesired characteristics and/or erroneous information) in the time shifted residual signal. As a practical matter, one effect of time shifting the residual signal is that the change in pitch period over time is rendered more uniform relative to the pitch content of the original speech signal. While this effect generally does not perceptually change voiced speech, it sometimes results in an audible increase in periodicity during unvoiced speech. Using the matching criterion defined above (equation (2)), a particular time shift, $T_{best}$, is selected so as to minimize or substantially reduce $\epsilon$. As stated above, $\epsilon$ represents the correlation of a residual signal to the time-shifted version of that same signal. A normalized correlation measure is then defined as $$G_{opt}=\frac{\Sigma_n r(n-T_{best})r(n-D)}{\Sigma_n r^2(n-D)}. \quad (3)$$

Although time shifting the residual signal may cause an undesired introduction of periodicity into non-periodic speech segments, this effect can be substantially reduced by not time shifting the residual signal within a given sub-frame when $G_{opt}$ is smaller than a specified threshold. A peak-to-average ratio criterion, defined as peak-to-average=(the energy of a pulse in the residual signal)/(the average energy of the residual signal), is employed for purposes of determining whether or not time shifting should be applied to the residual signal within a given sub-frame. If peak-to-average is greater than a specified threshold, then time shifting is not applied within a given sub-frame; otherwise, time shifting is applied to the residual signal.

DETAILED DESCRIPTION OF THE INVENTION

Figure 1:
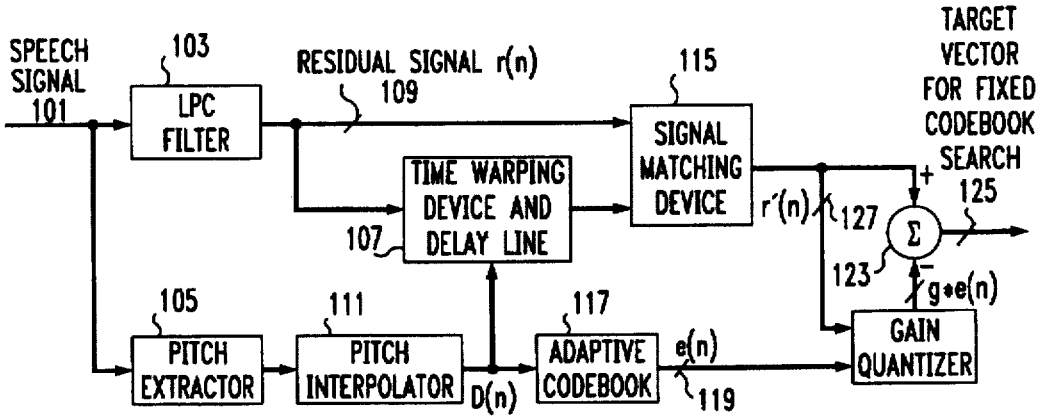
FIG. 1 is a hardware block diagram setting forth an illustrative embodiment of the invention.

Refer to FIG. 1, which is a hardware block diagram setting forth an illustrative embodiment of the invention. A digitized speech signal 101 is input to a pitch extractor 105. Digitized speech signal 101 is organized into a plurality of temporally-defined frames, and each frame is organized into a plurality of temporally-defined sub-frames, in accordance with existing speech coding techniques. Each of these frames includes a pitch delay parameter that specifies the change in pitch value from a predefined reference point in a given frame to a predefined point in the immediately preceding frame. These predefined reference points remain at a specified position relative to the start of a frame, and are typically situated at or near a frame-to-frame boundary. Pitch extractor 105 extracts this pitch delay parameter from speech signal 101. A pitch interpolator 111, coupled to pitch extractor 105, applies linear interpolation techniques to the pitch delay parameter obtained by pitch extractor 105 to calculate interpolated pitch delay values for each sub-frame of speech signal 101. In this manner, pitch delay values are interpolated for portions of speech signal 101 that are not at or near a frame-to-frame boundary. Each sub-frame may be conceptualized as representing a given digital sample of speech signal 101, in which case the output of pitch interpolator 111, denoted as D(n), represents linearly-interpolated sample-by-sample pitch delay. The linearly-interpolated sample-by-sample pitch delay, D(n), is then input to an adaptive codebook 117, and also to a time warping device and delay line 107, to be described in greater detail hereinafter.

Speech signal 101 is input to a linear predictive coding (LPC) filter 103. The selection of a suitable filter design for LPC filter 103 is a matter within the knowledge of those skilled in the art, and virtually any existing LPC filter design may be employed for LPC filter 103. The output of LPC filter 103 is a residual signal r(n) 109. Residual signal r(n) 109 is fed to time warping device and delay line 107. Based upon residual signal r(n) 109 and linearly-interpolated sample-by-sample pitch delay D(n), time warping device and delay line 107 applies a temporal distortion to residual signal r(n) 109. The term "temporal distortion" means that a portion of residual signal r(n) is linearly translated by a specified amount along an axis representing time. In other words, time warping device and delay line 107 applies a selected amount of time shift T to a portion of residual signal r(n) 109. Time warping device and delay line 107 is adapted to apply each of a plurality of known values of time shift T to a given portion of residual signal r(n), thereby generating a plurality of temporally distorted residual signals r(n). This plurality of temporally distorted residual signals r(n) are generated in order to determine an optimum or best value for time shift T.

To determine the optimum or best value for time shift T, a signal matching device 115 is employed. The output of time warping device and delay line 107, representing a plurality of temporally-distorted versions of residual signal r(n), is input to a signal matching device 115. Signal matching device 115 compares each of the temporally distorted versions of the residual signal r(n−T) with the delayed residual signal r(n−D(n)), and selects the best temporally-distorted version of residual signal r(n−T) according to a matching criterion denoted as:

$$\epsilon=\sum_n (r(n-T)-r(n-D(n)))^2. \quad (2)$$

In the above equation, the expression (r(n−T)) represents the residual speech signal of the current frame shifted by time T, and the expression r(n−D(n)) represents the delayed residual signal from a previously-occurring frame, wherein n is a positive integer, r is the instantaneous amplitude of the residual signal, and D(n) represents the adaptive codebook delay function. The output of signal matching device 115, denoted as r'(n) 127, represents a time shifted version of the residual signal r(n) 109, where r(n) has been shifted (linearly translated) in time by $T_{best}$.

The output of pitch interpolator 111, denoted as D(n), is input to an adaptive codebook 117. Adaptive codebook 117 may, but need not, be of conventional design. The selection of a suitable apparatus for implementing adaptive codebook 117 is a matter within the knowledge of those skilled in the art. In general, adaptive codebook 117 responds to an input signal, such as D(n), by mapping D(n) to a corresponding vector, referred to as adaptive codebook vector e(n) 119.

Adaptive codebook vector e(n) 119 and time-shifted residual signal r'(n) 127 are input to a gain quantizer 128. Gain quantizer 128 adjusts the amplitude of adaptive codebook vector e(n) 119 by a gain g to generate an output signal denoted as g*e(n). Gain g is selected such that the amplitude of g*e(n) is of the same order of magnitude as the amplitude of r'(n) 127. r'(n) 127 is fed to a first, non-inverting input of a summer 123, and g*e(n) is fed to a second, inverting input of summer 123. The output of summer 123 represents a target vector for a fixed codebook search 125.

Figure 2:
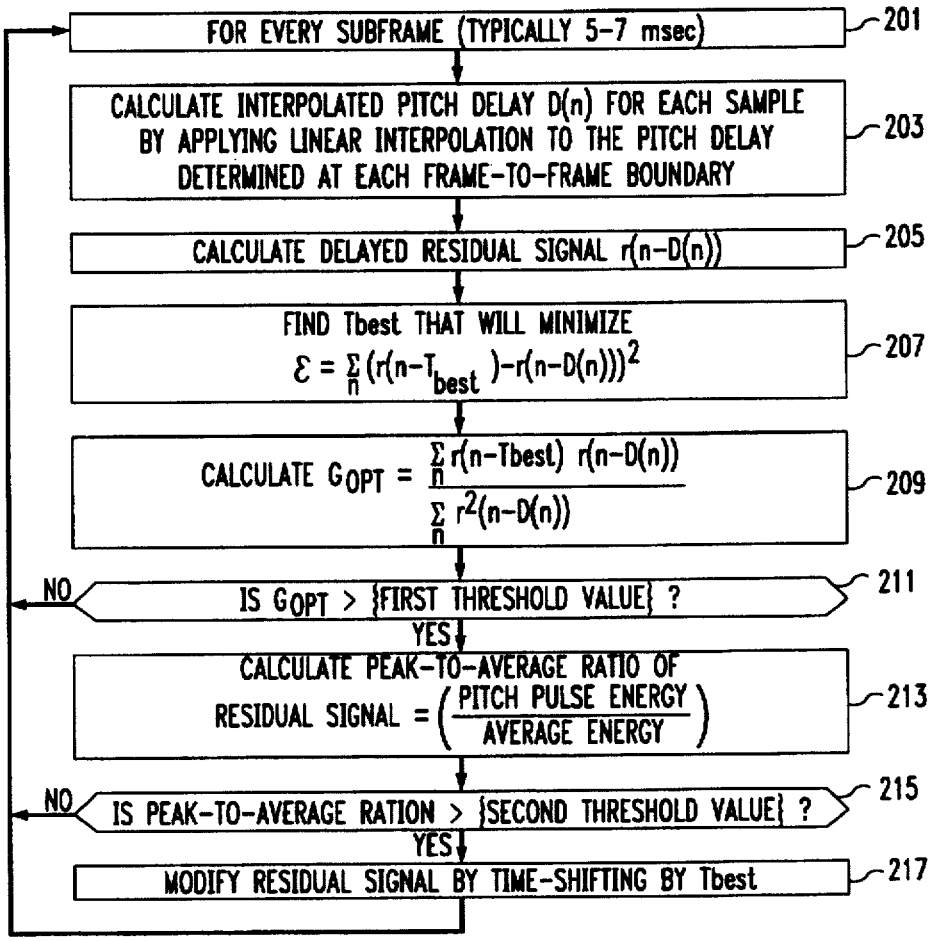
FIG. 2 is a software flowchart setting forth an operational sequence which may be performed using the hardware of FIG. 1.

FIG. 2 is a software flowchart setting forth an operational sequence which may be performed using the hardware of FIG. 1. At block 201, the program commences anew for each sub-frame of speech signal 101 (FIG. 1 ). Next, at block 203, a sample-by-sample, linearly-interpolated pitch delay D(n) is calculated for each sample. This calculation is performed by applying linear interpolation to the pitch delay values specified at or near each frame-to-frame boundary. A delayed residual signal, denoted as r(n–D(n)), is calculated at block 205. A value for $T_{best}$ is selected at block 207 so as to minimize the value of epsilon in the equation $$\epsilon = \sum_n (r(n-T) - r(n-D(n)))^2.$$

At block 209, the value of $G_{opt}$ is calculated using the equation $$G_{opt} = \frac{\Sigma_n r(n-T_{best}) r(n-D)}{\Sigma_n r^2(n-D)}.$$

A test is then performed at block 211 to ascertain whether or not $G_{opt}$ is greater than a first specified threshold value. If not, the program loops back to block 201. If so, the program advances to block 213 where the peak-to-average ratio of the residual signal r(n) is calculated as the ratio of energy in a pitch pulse of r(n) to the average energy of r(n). At block 215, a test is performed to ascertain whether or not the peak-to-average ratio is greater than a second specified threshold value. If not, the program loops back to block 201. If so, the program modifies residual signal r(n) by temporally shifting r(n) by $T_{best}$ (block 217), and the program loops back to block 201.

Figure 3A:
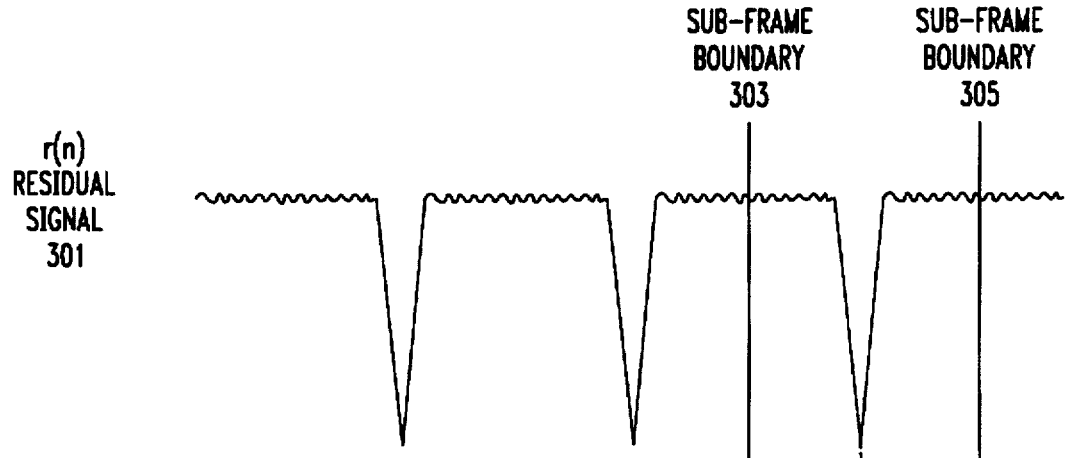
FIGS. 3A and 3B are waveform diagrams showing various illustrative waveforms that are processed by the system of FIG. 1.
Figure 3B:
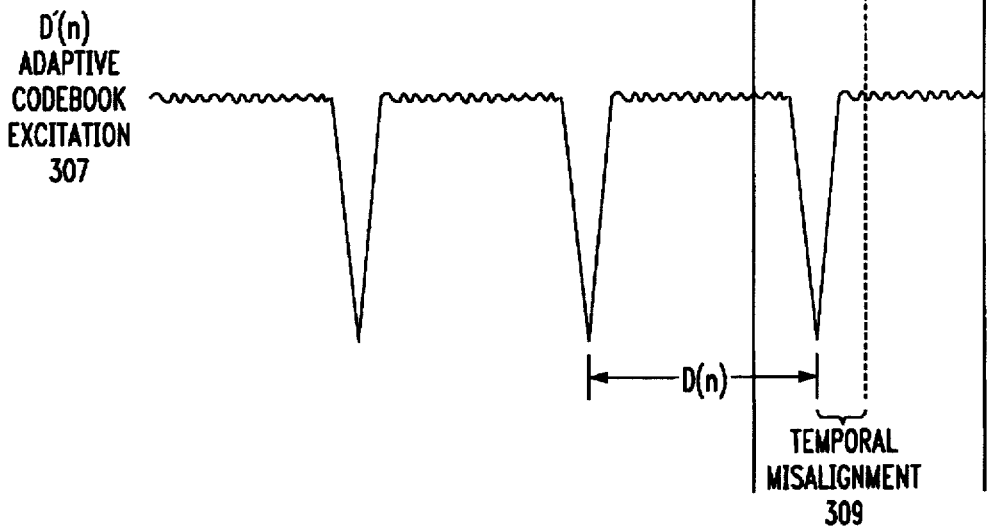

FIGS. 3A and 3B are waveform diagrams showing various illustrative waveforms that are processed by the system of FIG. 1. FIG. 3A shows an illustrative residual signal r(n) 301, and FIG. 3B shows an illustrative adaptive codebook excitation signal D'(n) 307. This adaptive codebook excitation signal D'(n) 307 may also be referred to as adaptive codebook excitation e(n–D(n)) (e.g., equation (1)). Therefore, D'(n) is a shorthand notation for e(n–D(n)). Residual signal r(n) 301 and adaptive codebook excitation signal D'(n) 307 are drawn along the same time scale, which may be conceptualized as traversing FIGS. 3A and 3B in a horizontal direction. A first sub-frame boundary 303 and a second sub-frame boundary 305 define sub-frames for residual signal r(n) 301 and adaptive codebook excitation signal D'(n)307. In practice, adaptive codebook excitation signal D'(n) 307, including D(n), is used to retrieve an adaptive codebook vector e(n) 119 from adaptive codebook 117 (FIG. 1).

Note that the waveform of residual signal r(n) 301 has a specific pitch period, which may be specified as a real number, such as 40.373454. However, using conventional RCELP techniques, integer values are generally used to specify the pitch period of adaptive codebook excitation D'(n) 307, and no additional bits are employed to represent decimal fractions. If additional bits were employed to store real number values, the resulting additional cost and complexity would render such a system impractical and/or expensive. Since the closest integer value to 40.373454 is 40, the pitch period of adaptive codebook excitation D'(n) 307 is specified as 40.

Since the pitch period of adaptive codebook excitation D'(n) 307 cannot always be selected to identically match the pitch period of residual signal r(n), there is a temporal misalignment 309 between a pulse of residual signal r(n) 301 and the corresponding pulse of adaptive codebook excitation D'(n) 307. Existing RCELP techniques compensate for this temporal misalignment 309 by time-shifting the adaptive codebook excitation D'(n) 307 signal, whereas the techniques disclosed herein compensate for this temporal misalignment 309 by selectively time-shifting the residual signal r(n) 301.

The enhanced RCELP techniques described herein have been implemented in a variable-rate coder which was the AT&T candidate for a new Noah American CDMA standard. The coder was selected as the core coder for the standard. Table 1 shows the mean opinion score (MOS) results of the coder, which operates at a peak rate of 8.5 kb/s and a typical average bit rate of about 4 kb/s (the lowest rate is 800 b/s). Mean opinion scores represent the quality rating that human listeners apply to a given audio sample. Individual listeners are asked to assign a score of 1 to a given audio sample if the sample is of poor quality. A score of 2 corresponds to bad, 3 corresponds to fair, 4 signifies good, and 5 signifies excellent. The minimum statistically significant difference between mean opinion scores is 0.1.

Mean opinion scores (MOS)

| | Illustrative Embodiment | Proposed ITU 8kb/s | ITU G.728 |
|---|---|---|---|
| no frame erasures | 4.05 | 4.00 | 3.84 |
| 3% frame erasures | 3.50 | 3.14 | — |

From the table, it is seen that the improved generalized analysis-by-synthesis mechanism allows toll-quality (MOS=4) speech using only 350 b/s for the adaptive codebook delay. An additional 250 b/s for redundant adaptive codebook delay information allows the coder to maintain an MOS of 3.5 under 3% frame erasures.

The invention claimed is:

1. A method of speech coding for use in conjunction with speech coding methods wherein speech is digitized into a plurality of temporally defined frames, each frame having a plurality of sub-frames including a current sub-frame present during a specified time interval, each frame having a pitch delay value specifying the change in pitch with reference to the immediately preceding frame, each sub-frame including a plurality of samples, and the digitized speech is partitioned into periodic components and a residual signal; the improved method of speech coding comprising the steps of:

(a) for each of a plurality of sub-frames of the residual signal, determining a time shift T based upon (i) the current sub-frame of the residual signal, and (ii) a delayed residual signal from a previously-occurring frame; and (b) applying the time shift T determined in step (a) to the current sub-frame of the residual signal.

2. An improved method of speech coding as set forth in claim 1 wherein the time shift T is determined using a matching criterion defined as $$\epsilon = \sum_n (r(n-T) - r(n-D(n)))^2.$$

wherein (r(n–T)) is the residual signal of the current frame shifted by time T, r(n–D(n)) is the delayed residual signal from a previously-occurring frame, n is a positive integer, r is the instantaneous amplitude of the residual signal, and D(n) represents the sample-to-sample pitch delay determined by applying linear interpolation to known pitch delay values occurring at or near frame-to-frame boundaries.

3. A method of speech coding as set forth in claim 2 wherein the time shift T is determined so as to minimize the matching criterion $\epsilon$, wherein $\epsilon$ represents the correlation between a sub-frame of the residual signal and a time-shifted version of that residual signal.

4. A method of speech coding as set forth in claim 3 wherein a sub-frame of the residual signal is time shifted by time shift T only if a normalized correlation measurement $G_{opt}$ is greater than or equal to a specified threshold value, wherein $G_{opt}$ is defined as $$G_{opt} = \frac{\Sigma_n r(n-T)r(n-D)}{\Sigma_n r^2(n-D)} .$$

5. An improved method of speech coding as set forth in claim 4 wherein a sub-frame of the residual signal is time shifted by time shift T only if (a) $G_{opt}$ is greater than or equal to a specified first threshold value, and (b) a peak-to-average ratio is greater than or equal to a specified second threshold value, wherein the peak-to-average ratio is defined as the ratio of the energy of a pulse in a sub-frame of the residual signal to the average energy of the residual signal in that sub-frame, thereby eliminating or reducing the undesired introduction of periodicity into non-periodic speech segments.

* * * * *